US009371998B2

(12) United States Patent
Cramb et al.

(10) Patent No.: US 9,371,998 B2
(45) Date of Patent: Jun. 21, 2016

(54) SHROUDED PILOT LIQUID TUBE

(71) Applicant: Solar Turbines Incorporated, San Diego, CA (US)

(72) Inventors: Donald James Cramb, San Diego, CA (US); James Scott Piper, Bonita, CA (US); Sean Kelly Spivey, La Mesa, CA (US); Michael John Ramotowski, San Diego, CA (US); Matthew Mayer, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 316 days.

(21) Appl. No.: 13/893,180

(22) Filed: May 13, 2013

(65) Prior Publication Data

US 2014/0332603 A1 Nov. 13, 2014

(51) Int. Cl.

| | |
|---|---|
| ***B05B 1/28*** | (2006.01) |
| ***F23R 3/34*** | (2006.01) |
| ***F23R 3/12*** | (2006.01) |
| ***F23R 3/28*** | (2006.01) |
| ***F23D 11/36*** | (2006.01) |

(52) U.S. Cl.

CPC ..... *F23R 3/343* (2013.01); *F23D 11/36* (2013.01); *F23R 3/12* (2013.01); *F23R 3/283* (2013.01); *F23D 2900/00015* (2013.01); *F23R 2900/00017* (2013.01)

(58) Field of Classification Search

CPC ..... F23R 3/343; F23R 3/12; F23R 3/283; F23R 2900/00017; F23D 11/36; F23D 2900/00015

USPC ..... 239/104, 103

See application file for complete search history.

(56) References Cited

U.S. PATENT DOCUMENTS

| | | | | |
|---|---|---|---|---|
| 6,736,338 | B2 | 5/2004 | Johnson et al. | |
| 8,286,433 | B2 | 10/2012 | Piper et al. | |
| 2005/0039460 | A1* | 2/2005 | Sobieski | F02C 7/22 60/772 |
| 2008/0066720 | A1 | 3/2008 | Piper et al. | |
| 2009/0107147 | A1* | 4/2009 | Piper | F23R 3/14 60/738 |
| 2009/0113893 | A1* | 5/2009 | Li | F23R 3/14 60/737 |
| 2010/0011772 | A1 | 1/2010 | Gashi et al. | |
| 2010/0095677 | A1 | 4/2010 | Dawson et al. | |
| 2010/0175382 | A1 | 7/2010 | Eroglu | |
| 2010/0319350 | A1 | 12/2010 | Landry et al. | |
| 2011/0067403 | A1* | 3/2011 | Williams | F23R 3/286 60/742 |

FOREIGN PATENT DOCUMENTS

| | | |
|---|---|---|
| EP | 2420729 | 2/2012 |
| EP | 2489939 | 8/2012 |

* cited by examiner

*Primary Examiner* — Len Tran
*Assistant Examiner* — Joel Zhou
(74) *Attorney, Agent, or Firm* — Procopio, Cory, Hargreaves & Savitch LLP

(57) ABSTRACT

A pilot liquid tube having a pilot liquid fuel inlet, a pilot liquid fuel conduit, a pilot liquid fuel nozzle, and a shroud configured to shield the pilot liquid fuel nozzle. The pilot liquid tube may be installed and/or removed from an injector of a gas turbine engine while the shroud remains fixed to pilot liquid fuel conduit.

11 Claims, 5 Drawing Sheets

SHROUDED PILOT LIQUID TUBE

TECHNICAL FIELD

The present disclosure generally pertains to a fuel injector for a gas turbine engine, and is more particularly directed toward a gas turbine fuel injector with a removable pilot liquid tube.

BACKGROUND

Gas turbine engines ("GTE's") typically include one or more fuel injectors that direct fuel into a combustor for combustion. The fuel injectors may include multiple fuel paths or fuel streams, such as a main fuel stream and a pilot fuel stream. Due to the proximity of the fuel injector to the combustor, liquid fuel tubes providing liquid fuel to the pilot assembly (called pilot liquid tube) of the fuel injector may experience high temperatures during GTE operation. In addition to potential thermal damage to fuel injector components due to high temperature, prolonged exposure to these high temperatures may cause the pilot liquid tube to clog over time due to fuel coking.

U.S. Pat. App. Pub. No. 2010/0175382, Eroglu published on Jul. 15, 2010 shows a gas turbine burner. In particular, the disclosure of Eroglu is directed toward a burner of a gas turbine that includes a swirl generator and, downstream of it, a mixing tube. The swirl generator is defined by at least two walls facing one another to define a conical swirl chamber and is provided with nozzles arranged to inject a fuel and apertures arranged to feed an oxidizer into the swirl chamber. The burner includes a lance which extends along a longitudinal axis of the swirl generator and is provided with side nozzles for ejecting a fuel within the burner. The side nozzles have their axes inclined with respect to the axis of the lance and can be positioned along the axis of the burner.

The present disclosure is directed toward overcoming known problems and/or problems discovered by the inventors.

SUMMARY

A pilot liquid tube is disclosed herein. The pilot liquid tube includes a pilot liquid fuel conduit having a first and second end, and configured to conduct liquid fuel through the pilot liquid tube, a pilot liquid fuel inlet fluidly coupled to the pilot liquid fuel conduit at the first end, and configured to fluidly couple with a pilot fuel supply interface, and a pilot liquid fuel nozzle fluidly coupled to the pilot liquid fuel conduit at the second end, the pilot liquid fuel nozzle configured to spray the liquid fuel to the combustion chamber. The pilot liquid tube also includes a swirler coupled to pilot liquid fuel conduit, and a shroud coupled to the swirler, the shroud configured to circumscribe the pilot liquid fuel nozzle.

According to one embodiment, the pilot liquid tube includes a pilot liquid fuel conduit having a first and second end, and configured to conduct liquid fuel through the pilot liquid tube, and a pilot liquid fuel inlet fluidly coupled to the pilot liquid fuel conduit at the first end, the pilot liquid fuel inlet configured to fluidly couple with a pilot fuel supply interface. The pilot liquid tube also includes a shroud assembly. The shroud assembly includes a tube interface, a tube extension, a shroud, and a pilot liquid fuel nozzle. The shroud assembly is coupled to the pilot liquid fuel conduit at the second end via the tube interface. The pilot liquid fuel nozzle is fluidly coupled to the pilot liquid fuel conduit via the tube extension and is configured to spray the liquid fuel to the combustion chamber. The shroud is coupled to the tube extension and is configured to circumscribe the pilot liquid fuel nozzle.

DETAILED DESCRIPTION

The present disclosure relates to a fuel injector for a gas turbine engine. In particular, the disclosure provides for a liquid fuel tube (also referred to as a "lance") with an integrated tip that is heat and flow shielded. The lance may be removable from the injector and may be part of a pilot fuel assembly.

Figure 1:
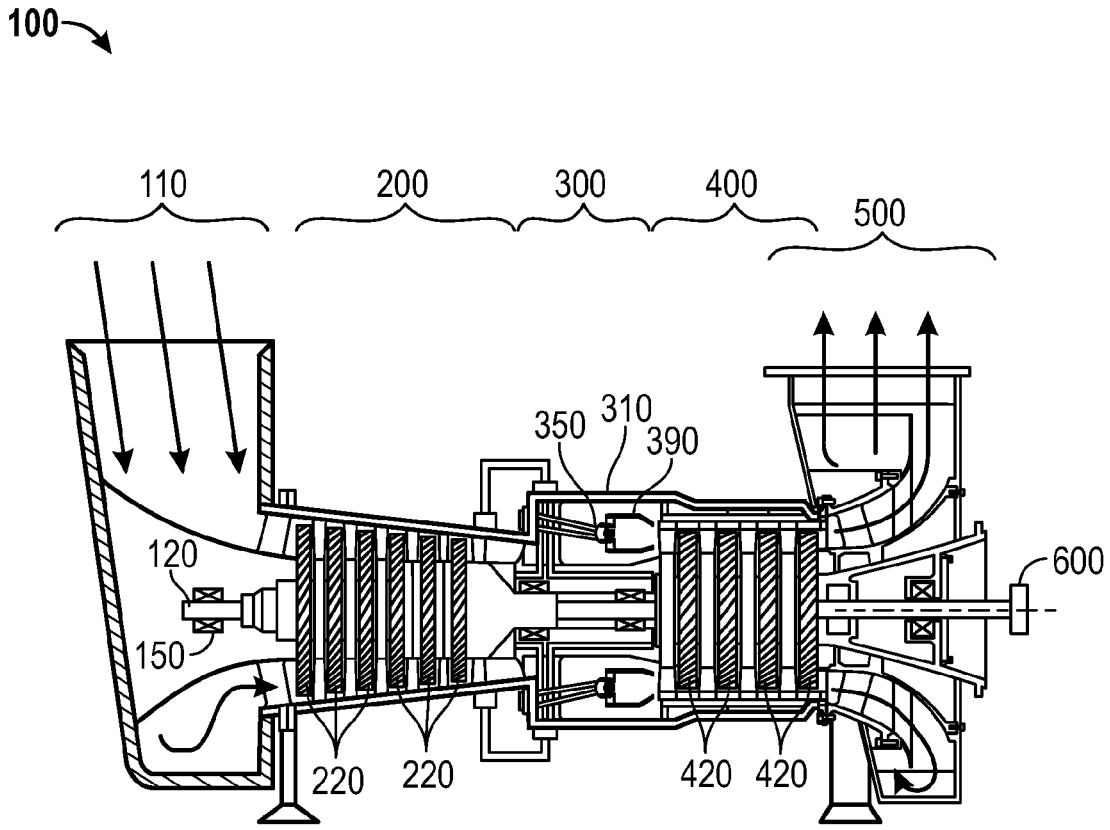
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Generally, the gas turbine engine 100 includes an inlet 110, a shaft 120 (supported by bearings 150), a compressor 200, a combustor 300, a turbine 400, an exhaust 500, and a power output coupling 600. The compressor 200 includes one or more compressor rotor assemblies 220. The combustor 300 includes a combustor case 310, one or more injectors 350 mounted to the combustor case 310, and one or more combustion chambers 390 installed within the combustor case 310. The turbine 400 includes one or more turbine rotor assemblies 420.

In operation, air enters the inlet 110 as a "working fluid", and is compressed by the compressor 200. In the compressor 200, the working fluid is compressed in an annular flow path by a series of compressor rotor assemblies 220. Once compressed, air leaves the compressor 200, it enters the combustor 300, where it is diffused and fuel is added. Air and fuel are injected into the combustion chamber 390 via injector 350 and ignited. After the combustion reaction, energy is then extracted from the combusted fuel/air mixture via the turbine 400 by a series of turbine rotor assemblies 420. Exhaust gas leaves the system via the exhaust 500.

The fuel delivered to combustor 300 may include any known type of hydrocarbon based liquid or gaseous fuel. Liquid fuels may include diesel, heating oil, JP5, jet propellant, or kerosene. In some embodiments, liquid fuels may also include natural gas liquids (such as, for example, ethane, propane, butane, etc.), paraffin oil based fuels (such as, JET-A), and gasoline. Gaseous fuels may include natural gas. In some embodiments, the gaseous fuel may also include alternate gaseous fuels such as, for example, liquefied petroleum gas (LPG), ethylene, landfill gas, sewage gas, ammonia, biomass gas, coal gas, refinery waste gas, etc. This listing of liquid and gaseous fuels is not intended to be an exhaustive list but merely exemplary. In general, any liquid or gaseous fuel known in the art may be delivered to combustor 300 through injector 350.

Similarly, one or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
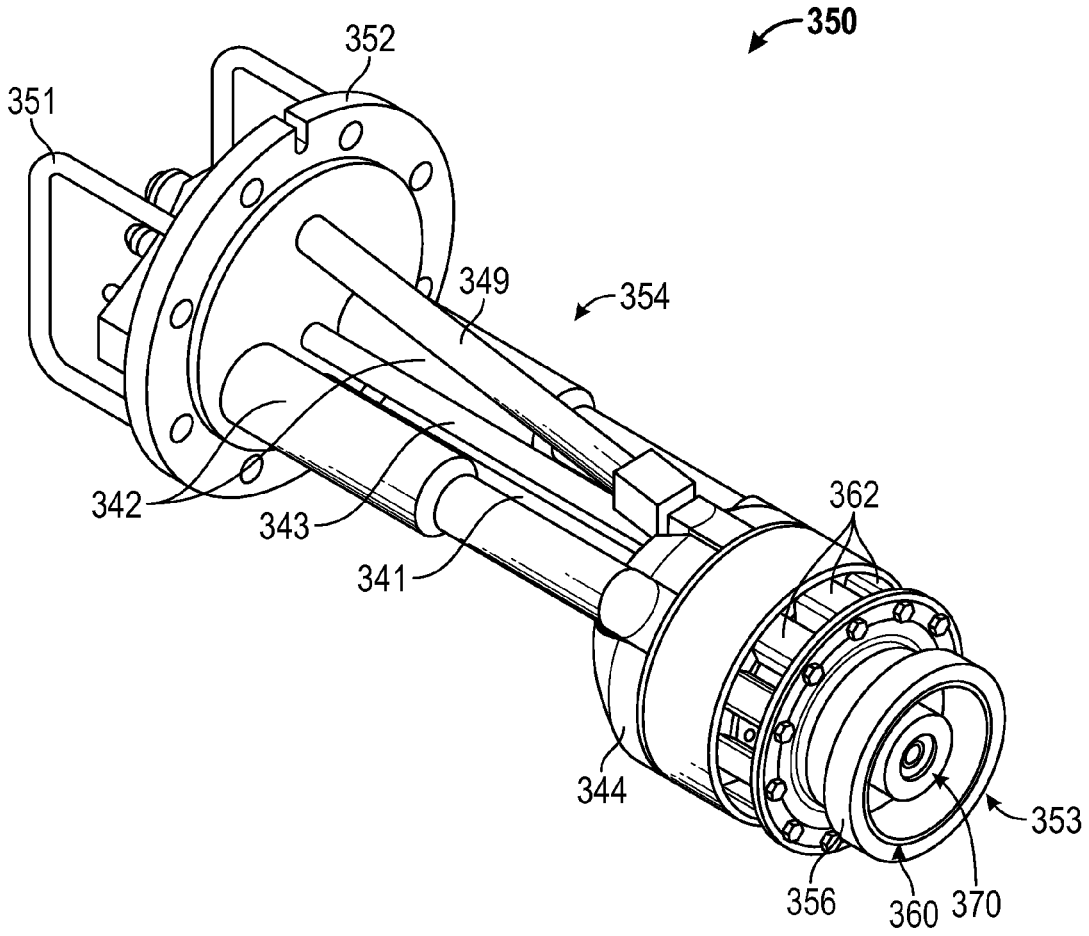
FIG. 2 is an isometric view of one of the injectors of FIG. 1.

FIG. 2 is an isometric view of an exemplary gas turbine injector of the gas turbine engine of FIG. 1. As illustrated, injector 350 may include mounting handles 351, a mounting flange 352, a combustion chamber interface 353, an external injector body 354, and an air supply interface, as well as a pilot fuel assembly 370 and a primary fuel assembly 360. The mounting handles 351 and mounting flange 352 facilitate mounting the injector 350 to the combustor case 310 (FIG. 1).

The combustion chamber interface 353 mates the injector 350 with the combustion chamber 390 (FIG. 1). The combustion chamber interface 353 may include one or more portions of the pilot fuel assembly 370 and the primary fuel assembly 360 at their respective interface with the combustion chamber 390. In particular, combustion chamber interface 353 may include a collar 356 integrated into primary fuel assembly 360, which then slides into the injector interface of the combustion chamber 390.

The external injector body 354 may include one or more flow bodies that are exposed to the working fluid within the combustor 300 during operation (FIG. 1). The one or more flow bodies provide support, shield internal components, and/or form internal flowpaths. One or more of flow bodies may merge into or terminate at the mounting flange 352. Alternately, one or more flow bodies may pass through the mounting flange 352 and terminate beyond the mounting flange 352.

According to one embodiment and as illustrated, the external injector body 354 may include a pilot stem 341, a main gas tubes 342, a main liquid outer tube 343, an outer cap 344, and a support tube 349, each of which are configured to individually support and/or protect internal components of the injector 350. Here, the pilot stem 341, the main gas tubes 342, and the main liquid outer tube 343 shield internal fuel lines, whereas the outer cap 344 shields interfaces of the flow bodies. In addition, the pilot stem 341, the main gas tubes 342, and/or the main liquid outer tube 343 may form internal air passageway. The support tube 349 is shown as support between the head of the injector 350 and the mounting flange 352; however, the support tube 349 may be replaced with a shield to another internal fuel line pilot liquid fuel conductor be removed all together, depending on the particular design of the injector.

According to an alternate embodiment, the external injector body 354 may be a single flow body configured to collectively protect the internal components of the injector 350. In particular all the fuel and or air passageways may be collectively within the single flow body which both shields and supports them, as well as supports the head of the injector 350.

Figure 3:
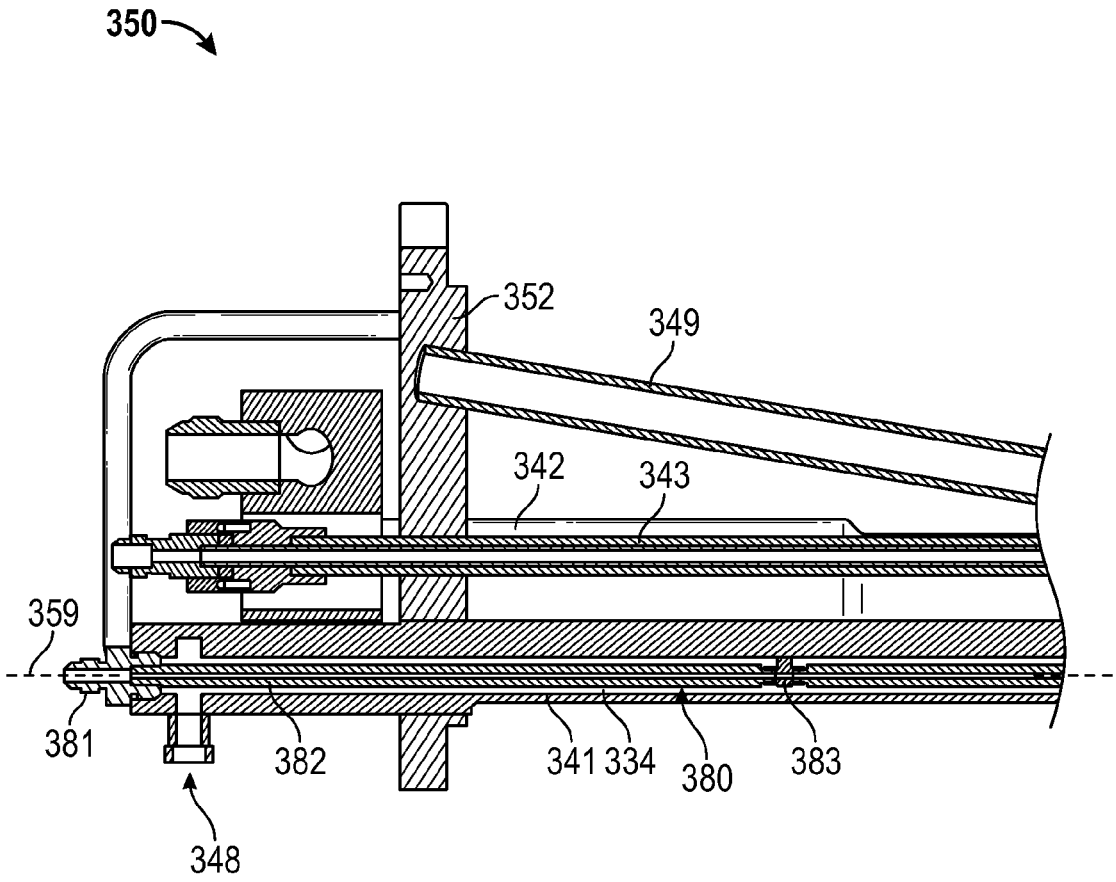
FIG. 3 is a cutaway side view of a first part of the injector of FIG. 2.
Figure 4:
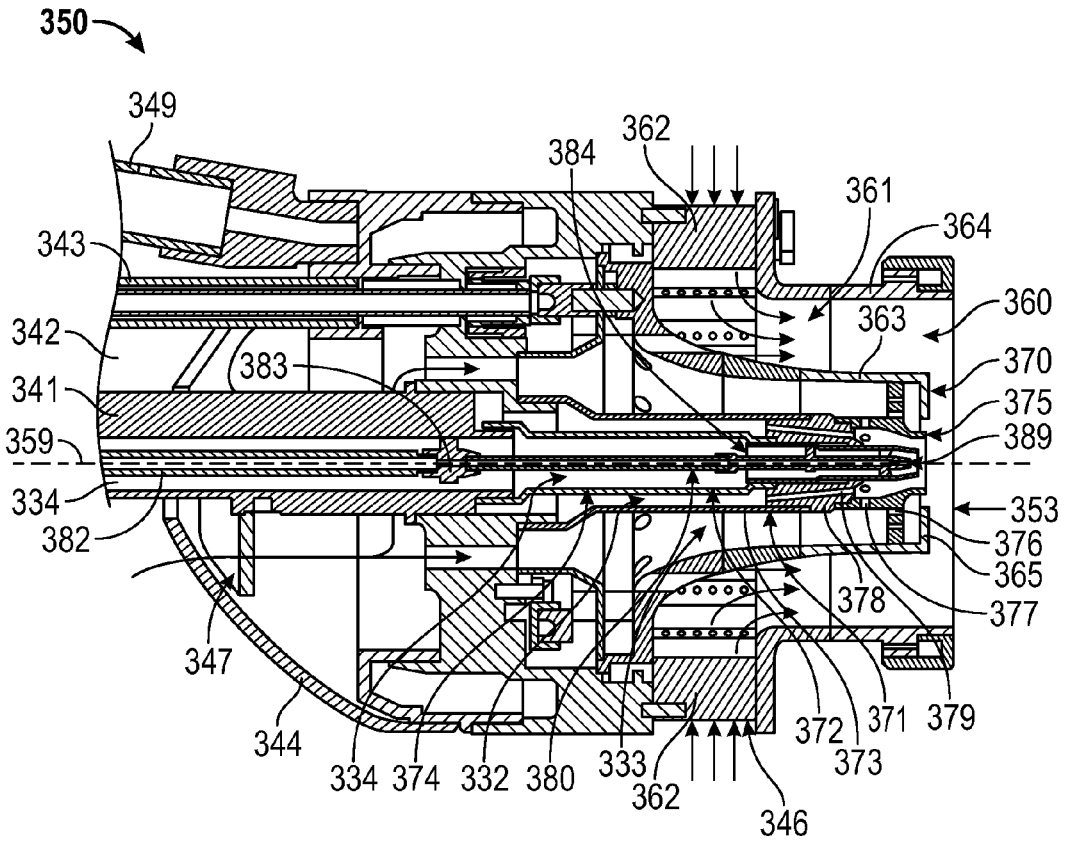
FIG. 4 is a cutaway side view of a second part of the injector of FIG. 2.

FIG. 3 and FIG. 4 are cutaway side views of a first and a second portion of the injector of FIG. 2, respectively. In particular, injector 350 is shown as a dual-fuel injector that is also configured to deliver both pilot fuel and primary fuel to the combustion chamber 390 (FIG. 1). For example, the injector 350 may include a pilot fuel assembly 370 and a primary fuel assembly 360. In the illustrated embodiment, the pilot fuel assembly 370 and the primary fuel assembly 360 may have a generally tubular configuration with an inner and an outer tube arranged concentrically about an injector center axis 359.

Here, unless otherwise specified, all references to "upstream" and "downstream" are with reference to the flow direction of fuel through the injector 350 during operation. For example, the mounting flange 352 is generally at the most "upstream" position, and the combustion chamber interface 353 is generally at the most "downstream". Additionally, references to "upstream" and "downstream" are with reference to the injector center axis 359.

As illustrated, the injector 350 is configured to receive compressed air. In particular, the injector 350 may be configured to receive compressed air for the combustion reaction and for cooling. The injector 350 may include any convenient interface or interfaces configured to receive the compressed air. In particular, the injector 350 may include a primary air inlet 346 configured to receive compressed air for use with the primary fuel assembly 360. Similarly, the injector 350 may include a primary pilot air interface 347 configured to supply primary air (i.e., for a combustion reaction) to a primary pilot air duct 333 within the pilot fuel assembly 370. Likewise, the pilot air inlet may include a secondary pilot air interface 348 configured to supply secondary air (i.e., for a non-combustion uses such as cooling and pressurization) or shop air to a secondary pilot air duct 334 within the pilot fuel assembly 370. for use with the pilot fuel assembly 370.

According to one embodiment, the primary air inlet 346 may include a plurality of radial openings in the injector 350 between each swirler vane 362, and accompanying air passageways leading to the premix duct 361. According to another embodiment, the primary pilot air interface 347 may include an opening in the outer cap 344, and accompanying air passageways leading to a ring manifold that feeds the primary pilot air duct 333. According to another embodiment, the secondary pilot air interface 348 may include a pneumatic fitting attached to the pilot stem 341 and pneumatically coupled to a ring manifold configured to feed the secondary pilot air duct 334. Alternately, the secondary pilot air interface 348 may include a pneumatic fitting attached to the mounting flange 352 and pneumatically coupled to a ring manifold configured to feed the secondary pilot air duct 334.

The primary fuel assembly 360 may include a plurality of swirler vanes 362, an inner premix tube 363, and an outer premix barrel 364. The swirler vanes 362 are configured to receive primary air from the primary air inlet 346, and inject primary fuel into the air stream while imparting an angular component to its flow (also see FIG. 2). The outer wall of the inner premix tube 363 and inner wall of the outer premix barrel 364 together form a premix duct 361. The premix duct 361 forms the initial stage of a lean-premix combustion ("LPC") combustion reaction, discussed below. The premix duct 361 is configured to mix primary fuel and primary air, and direct it into the combustion chamber 390. In addition, the inner premix tube 363 may include a pilot impingement shield 365. Here, the pilot impingement shield 365 extends radially inward from a downstream end of the inner premix tube 363.

The pilot fuel assembly 370 is illustrated as a dual-fuel pilot, and may include a pilot gaseous fuel assembly 371 and a pilot liquid fuel assembly 372. In particular, the pilot gaseous fuel assembly 371 is configured to inject compressed air from the primary pilot air duct 333, and gaseous fuel from the pilot fuel assembly 370 into the combustion chamber 390. Similarly, the pilot liquid fuel assembly 372 is configured to inject compressed air from the secondary pilot air duct 334, and liquid fuel from the pilot fuel assembly 370 into the combustion chamber 390. For example, in the illustrated embodiment, the pilot gaseous fuel assembly 371 may inject an annular flow of premixed gaseous fuel, and the pilot liquid fuel assembly 372 may inject a conical atomized spray of liquid fuel.

The pilot gaseous fuel assembly 371 may be an annular assembly coupled to the injector 350, and having a longitudinal axis concentric with the injector center axis 359. As illustrated, the pilot gaseous fuel assembly 371 may include a pilot gas shroud 373, an air assist shroud 374, a pilot primary air tip 375, and a pilot gas tip 378. In addition, the pilot gaseous fuel assembly 371 may share or use an inner wall of the inner premix tube 363.

Together, the inner wall of the inner premix tube 363 and an outer wall of the pilot gas shroud 373 form the primary pilot air duct 333. In this configuration, the primary pilot air duct 333 receives primary air axially via the primary pilot air interface 347, and routes the primary air for downstream use, while transitioning to an annular duct shape. Similarly, an inner wall of the pilot gas shroud 373 and an outer wall of the air assist shroud 374 form a pilot gas duct 332. The pilot gas duct 332 is generally shaped as an annular duct through which gaseous pilot fuel travels toward the combustion chamber 390.

In this configuration, the pilot gas duct 332 is capped off by the pilot gas tip 378. However, the pilot gas tip 378 includes a pilot gas nozzle 379. The pilot gas nozzle 379 includes a plurality of passageways that are configured to direct gaseous pilot fuel into a pilot pre-mix region of the pilot fuel assembly 370.

Similarly, in this configuration, the primary pilot air duct 333 terminates with a pilot primary air tip 375. The pilot primary air tip 375 includes a pilot tip cooling nozzle 376 and a pilot primary air nozzle 377. The pilot tip cooling nozzle 376 includes a plurality of passageways configured to direct pressurized primary air onto the pilot impingement shield 365. The pilot primary air nozzle 377 includes a plurality of passageways that are configured to direct pressurized primary air into the pilot pre-mix region of the pilot fuel assembly 370. Although the various ducts, tips, and nozzles are oriented as illustrated, it is understood that other orientations may be used as well. In addition, one or more components may be compound and/or combined with other structures.

The pilot liquid fuel assembly 372 may be a generally cylindrical assembly coupled to the injector 350, and having a longitudinal axis concentric with the injector center axis 359. As illustrated, the pilot liquid fuel assembly 372 may include a pilot liquid tube 380 and the air assist shroud 374. Here, the pilot liquid fuel assembly 372 shares the air assist shroud 374 with the pilot gaseous fuel assembly 371, using an inner wall of the air assist shroud 374. In particular, the pilot liquid tube 380 may be positioned within the air assist shroud 374, forming a portion of the secondary pilot air duct 334 between the pilot liquid tube 380 and the inner wall of the air assist shroud 374.

Liquid fuel delivered to the pilot fuel assembly 370 through the pilot liquid tube 380 may be sprayed into the combustion chamber 390 through a pilot liquid fuel nozzle 389 at the downstream end of the pilot liquid tube 380. Compressed air (secondary air or shop air) from the secondary pilot air duct 334 may also be injected into the combustion chamber 390 alongside the fuel spray. This liquid fuel spray and compressed air burn to form the diffusion flame in combustion chamber 390.

The air assist shroud 374 may be pneumatically coupled at one end to the pilot stem 341 and at the other end to the pilot gas tip 378. In addition, one end may include a fixed joint (e.g., brazed, threaded, etc.), while the other end may include a dynamic joint (e.g., slip joint) configured to allow for a range of relative motion during operation between the air assist shroud 374 and the pilot gas tip 378, or any other dynamic changes in or around the pilot fuel assembly 370 (e.g., thermal expansion/contraction). Furthermore, the air assist shroud 374 may be configured to transition the effective flow area downstream of the pilot stem 341. For example, the air assist shroud 374 may be of a generally tubular shape including an upstream portion have a first diameter, and a downstream portion having a second (e.g., smaller) diameter, affecting the effective flow area of the secondary pilot air duct 334 through the air assist shroud 374.

Figure 5:
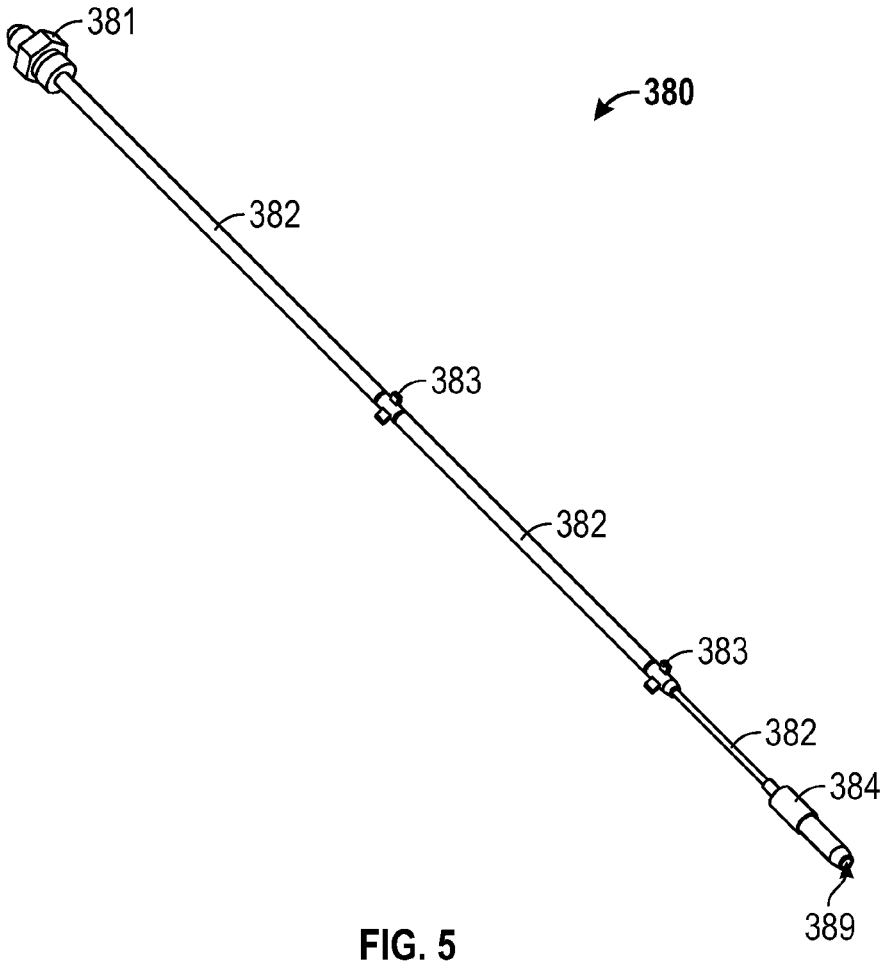
FIG. 5 is an isometric view of the pilot liquid tube of FIG. 3 and FIG. 4.

FIG. 5 is an isometric view of the pilot liquid tube of FIG. 3 and FIG. 4. The pilot liquid tube 380 may be an elongate assembly removably coupled to the injector 350, and having a longitudinal axis concentric with the injector center axis 359. The pilot liquid tube 380 includes a pilot liquid fuel inlet 381, a pilot liquid fuel conduit 382, a conduit support 383, and a shroud assembly 384. For example, the pilot liquid tube 380 may be inserted into (and removed from) the pilot stem 341, and coupled to the pilot stem 341 with the pilot liquid fuel inlet 381. The pilot liquid tube 380 is configured to deliver fuel from outside the injector 350 to the pilot fuel assembly 370 via the pilot liquid fuel nozzle 389.

The pilot liquid fuel inlet 381 may include any convenient interface or fitting to an outside fuel supply. In particular, the pilot liquid fuel inlet 381 is configured to form a fluid couple with a pilot fuel supply interface and the pilot liquid fuel conduit 382. In addition, the pilot liquid fuel inlet 381 may be configured to be removably coupled to the injector 350. For example, the pilot liquid fuel inlet 381 may include a standard liquid fuel bulkhead fitting that screws into, or otherwise fastens to the mounting flange 352. Also for example, pilot liquid fuel inlet 381 may be made of NITRONIC 60 stainless steel, or any other suitable material.

The liquid fuel conduit 382 may include any suitable fuel conduit, such as standard liquid fuel tubing, and is configured to deliver fuel between the pilot liquid fuel inlet 381 and the pilot liquid fuel nozzle 389. The pilot liquid fuel conduit 382 may be made of Grade 316 L stainless steel, or any other suitable material. According to one embodiment, pilot liquid fuel conduit 382 may be segmented to include two or more joined sections. For example and as illustrated, the pilot liquid fuel conduit 382 may have a first, second, and third section, with the first section being nearest the pilot liquid fuel inlet 381. In addition, the different sections may be made up of different materials. For example, the first and second sections of pilot liquid fuel conduit 382 may be made may be made of Grade 316 L stainless steel, or any other suitable material, whereas the third section may be made of Alloy 625 or any other suitable temperature-resistant material.

The conduit support 383 may include any suitable stand-off or fixed spacer configured to support the pilot liquid fuel conduit 382 within a passageway of the injector 350 while permitting secondary pilot air to pass, during operation. In particular, the pilot liquid tube 380 may be positioned within the pilot stem 341, the air assist shroud 374, and the shroud assembly 384, forming the secondary pilot air duct 334 between the exterior of the pilot liquid fuel conduit 382 and the interiors of the pilot stem 341, the air assist shroud 374 and the shroud assembly 384. The conduit support 383 is therefore configured to position the pilot liquid fuel conduit 382 (and extensions) and provide a flow path for the secondary pilot air duct 334. For example, the conduit support 383 may be formed as radially castellated annulus (or "star ring") slidably interfacing with and inner wall of the air assist shroud 374 at an outer periphery of the conduit support 383 and fixedly interfacing with the pilot liquid fuel conduit 382 at an inner periphery of the conduit support 383. Additionally, the conduit support 383 may be made of NITRONIC 60 stainless steel, or any other suitable material.

According to one embodiment, the conduit support 383 may be configured as a fitting or joint between two sections of the pilot liquid fuel conduit 382. For example and as illustrated, two sections may be inserted into aligned slots on opposite sides of the conduit support 383, and brazed or otherwise joined together as a single unit. In addition, the conduit support 383 may include differing slots such that tubes having differing outer diameters (OD) may be joined.

According to another embodiment, the conduit support 383 may include two or more stand-offs distributed along the pilot liquid fuel conduit 382. For example and as illustrated, where the pilot liquid fuel conduit 382 has first, second, and third sections, the conduit support 383 may include a first and a second conduit support 383, where the first conduit support 383 joins the first and second sections of the pilot liquid fuel conduit 382, and the second conduit support 383 joins the second and third sections of the pilot liquid fuel conduit 382. Alternately, one or more stand-offs may be positioned based on, and/or added to modify, a modal response of the pilot liquid tube 380.

Figure 6:
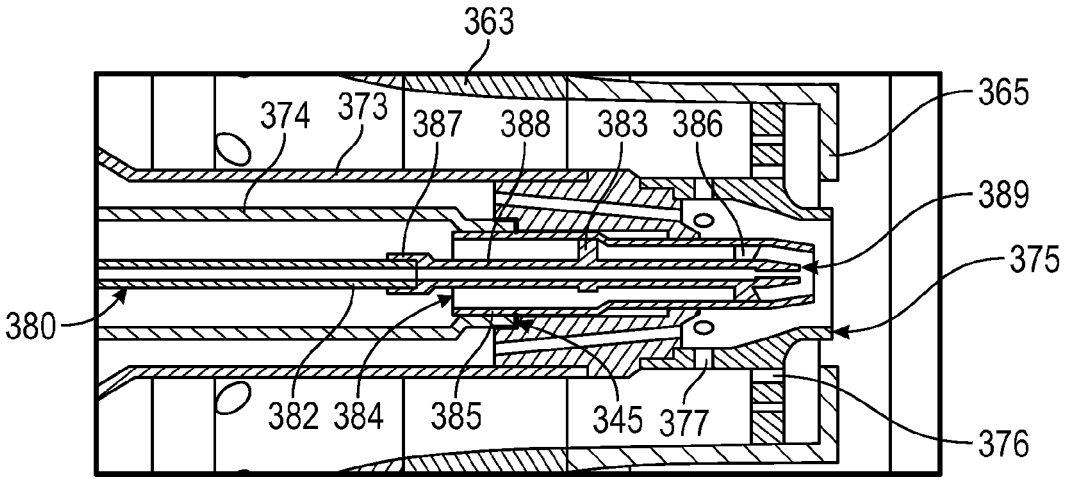
FIG. 6 is a cutaway side view of the shroud assembly of FIG. 4.

FIG. 6 is a cutaway side view of the shroud assembly of FIG. 4. The shroud assembly 384 may include a shroud 385, a swirler 386, and a tube interface 387. The shroud assembly 384 may further include a conduit support 383 within the shroud 385. The shroud assembly 384 is coupled to the pilot liquid fuel conduit 382 via the tube interface 387, and the shroud 385 is coupled to the swirler 386.

The pilot liquid tube 380 may be precalibrated prior to installation. In particular, the shroud assembly 384 may circumscribe the pilot liquid fuel nozzle 389 such that a predetermined effective flow area at the exit of the pilot liquid tube 380 is defined prior to being installed into the gas turbine engine 100 and/or the injector 350. In addition, the shroud assembly 384 is configured to be installed and removed from the injector 350 as part of the pilot liquid tube 380, and while the injector 350 remains installed in the combustor 300. Additionally, the shroud assembly 384 may be made of Alloy 625, or any other suitable temperature-resistant material.

The shroud 385 may include any suitable members configured to duct secondary pilot air, to encapsulate the swirler 386, and to shield the pilot liquid fuel nozzle 389. In particular, the shroud 385 interfaces with an upstream portion of the secondary pilot air duct 334, and axially extends it downstream beyond the pilot liquid fuel nozzle 389, thus completing the secondary pilot air duct 334. In addition, the shroud 385 extends downstream of the pilot primary air nozzle 377 into the pilot pre-mix region, shielding the pilot liquid fuel nozzle 389 from impingement by the pressurized primary air exiting the pilot primary air nozzle 377 during operation.

According to one embodiment, the shroud 385 may have a generally tubular shape, circumscribing, inter alia, the pilot liquid fuel nozzle 389. For example the shroud 385 may generally form a round tube but include a tapered exhaust tip. Also for example, the shroud 385 may include an upstream portion having a first diameter, and a downstream portion having a second (e.g., smaller) diameter. In addition, the shroud 385 may include intermediate variations in cross section. For example, the shroud 385 may have a cross section (e.g., diameter, shape, etc.) that varies at each interface (e.g., at the swirler 386, at the air assist shroud 374, etc.). Moreover, the cross section transitions between each intermediate variation follow a step, linearly transition, or follow a curve.

According to one embodiment, the shroud 385 may have an axial length, extending upstream to the swirler 386 but not beyond. According to another embodiment, the shroud 385 may extend upstream to, and interface with the air assist shroud 374. According to yet another embodiment, the shroud 385 may extend upstream, and beyond a downstream end of the air assist shroud 374. For example, where the air assist shroud 374 includes a dynamic joint with the pilot gas tip 378, the shroud 385 may extend upstream and sufficiently overlap the dynamic joint so as to axially overlap a joint interface 345 between the air assist shroud 374 and the pilot gas tip 378 throughout a range of relative motion or any dynamic changes during operation. Also, for example, the shroud 385 may extend upstream and well beyond the interface between the air assist shroud 374 and the pilot gas tip 378 (e.g., up to a transition in the effective flow area within the air assist shroud 374).

According to one embodiment, the shroud 385 extends axially downstream beyond the pilot liquid fuel nozzle 389, or put another way the pilot liquid fuel nozzle 389 is recessed within the shroud 385. In particular, the shroud 385 may extend between flush with the pilot liquid fuel nozzle 389 and a maximum extension. For example, the maximum extension may be up to the combustion chamber 390. Also for example, the maximum extension may set where an exit cone of an atomized liquid fuel exiting the pilot liquid fuel nozzle 389 will not impinge on the shroud 385. Also for example, the maximum extension may set where a 60 degree cone concentric with the pilot liquid fuel conduit 382 and whose vertex is set at the pilot liquid fuel nozzle 389 is free from intersecting or will not intersect the shroud 385.

According to the illustrated embodiment, the shroud assembly 384 may be an integrated unit attached to an end of the pilot liquid fuel conduit 382 distal from the pilot liquid fuel inlet 381. In particular, the shroud assembly 384 may further include a tube extension 388 and the pilot liquid fuel nozzle 389. The tube extension 388 is a fluid conduit, similar to the pilot liquid fuel conduit 382, extending between the tube interface 387 and the pilot liquid fuel nozzle 389. In this embodiment, the tube interface 387 may fluidly couple and attach the tube extension 388 to the end of the pilot liquid fuel conduit 382. Additionally, the swirler 386 may be coupled to the tube extension 388, and couple the shroud 385 to the tube extension 388.

According to another embodiment the shroud assembly 384 may attach to an outer wall of the pilot liquid fuel conduit 382. In particular, the tube interface 387 may include an inner periphery of the swirler 386, which is then fixed to the pilot liquid fuel conduit 382. In this embodiment the pilot liquid fuel conduit 382 may include and/or form the pilot liquid fuel nozzle 389.

The swirler 386 includes any suitable members configured to impart a rotational component of motion to secondary pilot air passing through the shroud 385 during operation. In particular, the swirler 386 includes swirl features that project into the secondary pilot air duct 334 and are configured to swirl the compressed secondary pilot stream. Moreover the swirl features may extend radially between the shroud 385 and the pilot liquid fuel conduit 382 and/or the tube extension 388. For example, the swirler 386 may include helical grooves that project into the secondary pilot air duct 334 as swirl features. Also for example, the swirler 386 may include a plurality of canted vanes that project into the secondary pilot air duct 334 as swirl features. Also for example, swirl features may be configured to impart 15 degrees of rotation, 30 degrees of rotation, or between 15 degrees and 30 degrees of rotation to the secondary pilot air flowing along the exterior of the pilot liquid fuel conduit 382 during operation.

According to one embodiment, the swirler 386 may include an annular array of the swirl features. For example, as illustrated, the swirler 386 may include three helical grooves aligned in a plane perpendicular to the pilot liquid fuel conduit 382. Moreover, the swirler 386 may include a plurality of the annular arrays distributed axially along the pilot liquid fuel conduit 382 and/or the tube extension 388. For example, the swirler 386 may include two sets of swirl features at different axial locations along the pilot liquid fuel conduit 382. In particular, the swirler 386 may include at least two annular arrays of swirl features, and the at least two annular arrays of swirl features may be spaced apart so as to provide a structural base for the shroud 385 to the pilot liquid fuel conduit 382 and/or the tube extension 388. Thus, according to one embodiment, the illustrated conduit support 383 may be replaced by a second swirler 386 instead.

Furthermore, each annular array of swirl features may be configured for different flow effects. For example, each annular array of the canted vanes may have a different angle of attack relative to the air flow, or each annular array of the helical grooves may have a different pitch. Also for example and as illustrated, where there are two annular arrays of the swirl features, the upstream array may have a larger diameter than the downstream array.

INDUSTRIAL APPLICABILITY

The present disclosure generally applies to gas turbine fuel injectors, and gas turbine engines having fuel injectors. The described embodiments are not limited to use in conjunction with a particular type of gas turbine engine, but rather may be applied to stationary or motive gas turbine engines, or any variant thereof. Gas turbine engines, and thus their components, may be suited for any number of industrial applications, such as, but not limited to, various aspects of the oil and natural gas industry (including transmission, gathering, storage, withdrawal, and lifting of oil and natural gas), power generation industry, aerospace and transportation industry, to name a few examples.

Generally, embodiments of the presently disclosed shrouded pilot fuel tube are applicable to the use, operation, maintenance, repair, and improvement of gas turbine engines, and may be used in order to improve performance and efficiency, decrease maintenance and repair, and/or lower costs. In addition, embodiments of the presently disclosed shrouded pilot fuel tube may be applicable at any stage of the gas turbine engine's life, from design to prototyping and first manufacture, and onward to end of life. Accordingly, the shrouded pilot fuel tube may be used as a retrofit or enhancement to existing gas turbine engine, as a preventative measure, or even in response to an event. This is particularly true as the presently disclosed shrouded pilot fuel tube may be installed in an injector having identical interfaces to be interchangeable with an earlier type of injector.

In this embodiment, the injector is configured for dry low emissions ("DLE")—i.e., without adding water to the combustion reaction. In particular, the primary fuel assembly 360 is configured for lean-premix combustion ("LPC") of its primary fuel. LPC may be used to reduce nitrogen oxide (NOx) emissions. In lean-premix injectors, fuel and air are thoroughly mixed in an initial stage upstream of the combustion chamber, resulting in a uniform, lean, unburned fuel/air mixture, which is then injected into a combustion chamber. Also, the primary fuel assembly may be configured to operate on liquid and/or gaseous fuel.

In addition, the pilot fuel assembly is configured to separately burn the pilot fuel, for example, via diffusion flame. Diffusion flames are flames that are created when fuel and air mix and burn at the same time in the combustion chamber, rather than being premixed in an initial stage. Diffusion flames may have a higher flame temperature than premixed flames, and may serve as a localized hot flame to stabilize the combustion process and prevent lean blowout. Also, the pilot fuel assembly may be configured to operate on liquid and/or gaseous fuel.

In use, the shrouded pilot liquid tube may be configured to be slidably installed into an injector while the shroud or shroud assembly is attached. In particular, the pilot liquid tube ("lance") may be slid into (or removed from) flow body of the injector, such as the pilot stem, and locked into place (or unlocked). In this configuration, the pilot liquid tube may be precalibrated before installation. In particular, the shroud or shroud assembly may be configured in advance to set or define an effective flow area or flow profile exiting the pilot liquid fuel assembly after installation and during operation. For example, rather than installing the lance and making adjustments to the injector, the effective flow area or flow profile may be set and/or determined in a calibration stand or fixture, since the shroud, and thus the exit of the compressed air, is present and can be fixed. In other words, with the shrouded pilot liquid tube, the boundary conditions are substantially present prior to its installation.

This is beneficial in balancing compressed air draw from multiple injectors. In particular, a combustor, having multiple injectors, may supply multiple injectors with compressed air from a single source. Moreover, the air supply may have limited pressure head available over boundary conditions at the exit of the pilot liquid fuel assembly. For example, final stage air may be cooled and supplied as secondary air.

Where one or more injector are out of balance with other injectors, the "pool" of available compressed air may be affected, thus affecting the compressed air available other injectors. By precalibrating the pilot liquid tube before installation, the inventors have found improvements in balancing compressed air draw from multiple injectors. For example, an injector including the shrouded pilot liquid tube as disclosed may see an installed tolerance of 2% to 5% to the nominal flow. Also for example, a combustor using injectors including the disclosed shrouded pilot liquid tube may see a flow variation of 2% to 5% between the injectors.

In operation, the shrouded pilot liquid tube may shield the pilot liquid fuel assembly from the pilot gaseous fuel assembly. In particular, the shroud may shield the pilot liquid fuel nozzle and the pilot liquid fuel conduit or the tube extension from hot compressed air leaving the primary pilot air duct. For example, the shroud may be positioned to intercept a stream of compressed air leaving the pilot primary air nozzle from direct or indirect impingement. As discussed above, the pilot liquid fuel nozzle may be significantly recessed (limited by fuel spray cone). Advantageously, the combination of shielding and cooled compressed secondary air may significantly reduce heat transfer to the pilot liquid fuel conduit and inhibit coking.

In operation, the shrouded pilot liquid tube may also assist in sealing the secondary pilot air duct from pilot gas duct. As discussed above, the shroud may extend upstream and overlap a dynamic joint, such as at the joint interface between the air assist shroud and the pilot gas tip, sufficiently to continue to overlap throughout any dynamic changes during operation. This overlapping of the interface of the dynamically joined components is beneficial in that it creates a more tortuous path between adjacent flows and may enhance the sealing of the dynamic joint.

The preceding detailed description is merely exemplary in nature and is not intended to limit the invention or the application and uses of the invention. The described embodiments are not limited to use in conjunction with a particular type of gas turbine engine. Hence, although the present embodiments are, for convenience of explanation, depicted and described as being implemented in a stationary gas turbine engine, it will be appreciated that it can be implemented in various other types of gas turbine engines, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A pilot liquid tube for use in a gas turbine engine, the pilot liquid tube comprising:

a pilot liquid fuel conduit having a first end, and a second end opposite the first end, the first end and the second end being in fluid communication;

a pilot liquid fuel inlet fluidly coupled to the pilot liquid fuel conduit at the first end;

a shroud assembly including a tube interface, a pilot liquid fuel nozzle, a tube extension extending between the tube interface and the pilot liquid fuel nozzle, a shroud circumscribing the pilot liquid fuel nozzle and the tube extension forming a portion of a secondary pilot air duct of an injector, and an integrated conduit support extending from the tube extension to the shroud and connecting the shroud to the tube extension forming an integrated unit, the shroud assembly coupled to the pilot liquid fuel conduit at the second end via the tube interface, the pilot liquid fuel nozzle fluidly coupled to the pilot liquid fuel conduit via the tube extension; and a swirler extending from the tube extension to the shroud connecting the shroud to the tube extension adjacent to the pilot liquid fuel nozzle, the swirler forming part of the integrated unit, wherein the swirler is configured to swirl compressed air passing through the shroud assembly;

wherein the integrated conduit support is located between the swirler and the tube interface; and wherein the shroud includes an upstream portion that circumscribes the integrated conduit support, the upstream portion including a first tubular shape with a first diameter, a downstream portion that circumscribes the swirler, the downstream portion including a second tubular shape with a second diameter smaller than the first diameter, and an intermediate portion that transitions from the upstream portion to the downstream portion.

2. The pilot liquid tube of claim 1, wherein the swirler is configured to impart between 15 degrees and 30 degrees of rotation to compressed air flowing along an exterior of the pilot liquid fuel conduit during operation.

3. The pilot liquid tube of claim 1, wherein the shroud and the pilot liquid fuel nozzle are configured together to define a predefined effective flow area exiting pilot liquid tube prior to installation into an injector of the gas turbine engine.

4. The pilot liquid tube of claim 1, further comprising at least one conduit support, the at least one conduit support configured to support the pilot liquid fuel conduit within a passageway of an injector, and further configured to permit flow along an exterior of the pilot liquid fuel conduit to pass the at least one conduit support during operation.

5. The pilot liquid tube of claim 4, wherein the pilot liquid fuel conduit is segmented into a plurality of joined sections, and at least two of plurality of joined sections are fluidly coupled via one of the at least one conduit support.

6. The pilot liquid tube of claim 1, wherein the pilot liquid fuel nozzle is recessed within the shroud.

7. The pilot liquid tube of claim 1, wherein the pilot liquid fuel nozzle is recessed within the shroud such that a 60 degree exit cone is free from intersecting the shroud.

8. An injector for a gas turbine engine, including the pilot liquid tube of claim 1, the injector further comprising:

a pilot gaseous fuel assembly including a pilot gas duct configured to duct gaseous pilot fuel during operation, a pilot gas tip including a pilot gas nozzle, the pilot gas tip configured to cap off the pilot gas duct, the pilot gas nozzle configured to direct the gaseous pilot fuel into a pilot pre-mix region of the injector, a primary pilot air duct configured to duct compressed primary air, and a pilot primary air nozzle configured to direct the compressed primary air, into the pilot pre-mix region; and a pilot liquid fuel assembly including an air assist shroud configured to duct compressed secondary air; and wherein the shroud is further configured to shield the pilot liquid fuel nozzle from impingement by the compressed primary air exiting the pilot primary air nozzle during operation.

9. The injector of claim 8, wherein the air assist shroud and the pilot gas tip are dynamically joined to each other, allowing for a range of relative motion during operation; and wherein the shroud is further configured to overlap a joint interface between the air assist shroud and the pilot gas tip throughout the range of relative motion.

10. A shroud assembly for a pilot liquid tube for use in an injector of a gas turbine engine, the shroud assembly comprising:

a tube interface configured to couple the shroud assembly to a pilot liquid fuel conduit;

a pilot liquid fuel nozzle;

a tube extension extending between the tube interface and the pilot liquid fuel nozzle, the tube extension including a fluid conduit;

a shroud circumscribing the pilot liquid fuel nozzle and the tube extension forming a portion of a secondary pilot air duct of the injector;

a conduit support extending from the tube extension to the shroud and connecting the shroud to the tube extension; and a swirler extending from the tube extension to the shroud connecting the shroud to the tube extension adjacent to the pilot liquid fuel nozzle, the swirler forming part of the integrated unit, and wherein the swirler is configured to swirl compressed air passing through the portion of the secondary pilot air duct;

wherein the shroud assembly including the tube interface, pilot liquid fuel nozzle, tube extension, shroud, and conduit support is an integrated unit configured to be installed and removed from the injector as a single unit;

wherein the conduit support is located between the swirler and the tube interface; and wherein the shroud includes an upstream portion that circumscribes the conduit support, the upstream portion including a first tubular shape with a first diameter, a downstream portion that circumscribes the swirler, the downstream portion including a second tubular shape with a second diameter smaller than the first diameter, and an intermediate portion that transitions from the upstream portion to the downstream portion.

11. The shroud assembly of claim 10, wherein the portion of the secondary pilot air duct includes the exit of the secondary pilot air duct and is configured to be precalibrated prior to installation into the injector.

* * * * *